United States Patent [19]

Amgar

[11] 4,362,034

[45] Dec. 7, 1982

[54] DOOR LOCKING DEVICE

[75] Inventor: Abraham Amgar, Holon, Israel

[73] Assignee: Hosem Reliable Protection System Ltd., Holon, Israel

[21] Appl. No.: 148,488

[22] Filed: May 9, 1980

[30] Foreign Application Priority Data

Jun. 8, 1979 [IL] Israel ..... 57523

[51] Int. Cl.[3] ..... E05B 59/00; E05B 63/14

[52] U.S. Cl. ..... 70/108; 70/120; 70/417; 292/39; 292/142

[58] Field of Search ..... 70/108–111, 70/113, 118, 120, 127, 150, 467, 468, 483, 417, 418; 292/39, 142, 347

[56] References Cited

U.S. PATENT DOCUMENTS

| | | | |
|---|---|---|---|
| 930,328 | 8/1909 | Wilkinson | 70/118 X |
| 1,018,475 | 2/1912 | Bedell | 292/39 |
| 1,565,754 | 12/1925 | Orth | 292/347 X |
| 1,910,125 | 5/1933 | Root | 292/347 X |
| 2,034,746 | 3/1936 | Ciak et al. | 292/347 |
| 2,714,814 | 8/1955 | Shaffer | 70/483 |
| 3,083,563 | 4/1963 | Greenwald | 70/417 |
| 3,175,376 | 3/1965 | Cantwell | 292/142 X |
| 4,037,440 | 7/1977 | Shabtai et al. | 70/108 |
| 4,074,552 | 2/1978 | Smith | 70/417 |
| 4,154,070 | 5/1979 | Bahry et al. | 70/108 |
| 4,160,368 | 7/1979 | Solow | 70/417 |
| 4,222,253 | 9/1980 | Peitsmeier | 70/417 |

FOREIGN PATENT DOCUMENTS

| | | | |
|---|---|---|---|
| 2380395 | 10/1978 | France | 70/417 |
| 2402048 | 4/1979 | France | 70/417 |
| 529250 | 6/1955 | Italy | 70/120 |
| 72338 | 12/1952 | Netherlands | 70/483 |

*Primary Examiner*—William E. Lyddane
*Attorney, Agent, or Firm*—Benjamin J. Barish

[57] ABSTRACT

A door-locking device is described including a plurality of locking bars drivable to a locking position projecting from the sides of the door into the door frame by means of a rotatable drive gear and a plurality of gear-cam segments, one for each locking bar. Each segment includes gear teeth formed on a first portion of its outer circumference meshing with the teeth of the drive gear, and a cam surface formed on a second portion of its outer circumference engageable by a cam follower carried by its respective locking bar. The locking device further includes a key-operated locking cylinder and an overlying protector plate having an opening covered by a disc formed with the key slot, the disc being yieldingly secured to the protector plate to thereby prevent a drill from penetrating same into the lock cylinder.

8 Claims, 6 Drawing Figures

DOOR LOCKING DEVICE

BACKGROUND OF THE INVENTION

The present invention relates to improvements in locking devices particularly for doors. The invention is especially directed to door locking devices of the type which include a plurality of locking bars projectable from all four sides of a door into recesses in the door frame, and is therefore described below with respect to this application.

A number of such door locking devices are now in use. As a rule, however, the known devices have a limited movement of the locking bars from their withdrawn unlocking positions to their projected locking positions, which limited movement affects the locking strength of the bars when in their locking positions. In addition, in the known devices the force applied to the locking bars, in case of an attempted forced entry, is usually taken-up by relatively weak structural elements, such as pins. Thus, the known locking devices of this type generally can withstand only a force of up to about 400 Kgm if a forced entry is attempted.

BRIEF SUMMARY OF THE INVENTION

An object of the present invention is to provide a locking device having advantages in the foregoing respects as will be described more particularly below.

According to one aspect of the present invention, there is provided a locking device mountable within a door and including one or more locking bars driven by actuator means to a locking position projecting from one or more sides of the door into the door frame, or to an unlocking position withdrawn from the door frame, characterized in that the actuator means includes a rotatable drive gear and one or more gear-cam segments driven by the drive gear and each coupled to at least one of the locking bars for driving same; each of said segments including gear teeth formed on a first portion of its outer circumference meshing with the teeth of the drive gear, and a cam surface formed on a second portion of its outer circumference engageable by a cam follower carried by its respective locking bar.

In the preferred embodiment of the invention described below, each of the gear-cam segments includes a pair of pins movable within a substantially T-shaped cam slot formed with first and second legs in a fixed cam plate; one of said pins being located at an intermediate portion of the gear-cam segments which, in the unlocking position thereof, is at the juncture of the two legs of the cam slot and is movable along the second leg thereof when the gear-cam segment is driven by the drive gear to its unlocking position; the other of said pins being coupled to the respective locking bar and being located at an end portion of the respective gear-cam segment which, in the unlocking position thereof, is at the outer end of the first leg of the T-shaped cam slot and is movable therealong to the inner end of said first leg when the gear-cam segment is driven by the drive gear to its unlocking position.

In the described embodiment, the locking device includes four of said gear-cam segments for actuating locking bars projectable from four sides of the door, said cam plate being fixed to the locking device such that said first legs of all the cam slots are located on radial lines passing through the axis of said drive gear, and said second legs are all located on a circular line having its center at the axis of said drive gear.

Such a construction provides a number of advantages over the known locking devices of this type.

One important advantage is that it provides a relatively large amplitude of movement of the locking bars from their unlocking positions to their locking positions. For example, whereas the locking devices now in use provide a maximum locking bar movement of about 19 mm, in the embodiment of the invention described below the movement of the locking bars may be 30 mm, thereby producing a deeper penetration of the locking bars into the door frame recesses, and a better securement of the door when the bars are in their locking position.

In addition, the foregoing arrangement increases the load that the locking bars can withstand in case a forced entry is attempted. Thus, whereas in the locking devices now in use the load while such locking bars can withstand is usually limited to about 400 Kgm, in the embodiment of the invention described below, the load capability is increased to about 800 Kgm. This is because the load, in the event of an attempted forced entry, is taken-up by structurally strong elements, namely the gear-cam segments, particularly by their cam surfaces engageable by cam followers carried by the ends of the respective locking bars.

According to a still further feature of the present invention, there is provided a locking device including a casing, a key-operated lock cylinder disposed within the casing, and actuator means disposed within the casing for driving a locking member to locking or unlocking position, characterized in that the locking device further includes a protector plate secured to the casing so as to be disposed externally thereof and covering the key-operated cylinder, said protector plate having an opening covered by a disc formed with the key slot, which disc is yieldingly secured to the protector plate externally of the casing and aligned with the key-operated lock cylinder, such that if an attempt is made to drill through the lock cylinder, the drill will first engage the disc which disc will rotate with the drill with respect to the protector plate and thereby prevent the drill from penetrating same to the lock cylinder.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 2:
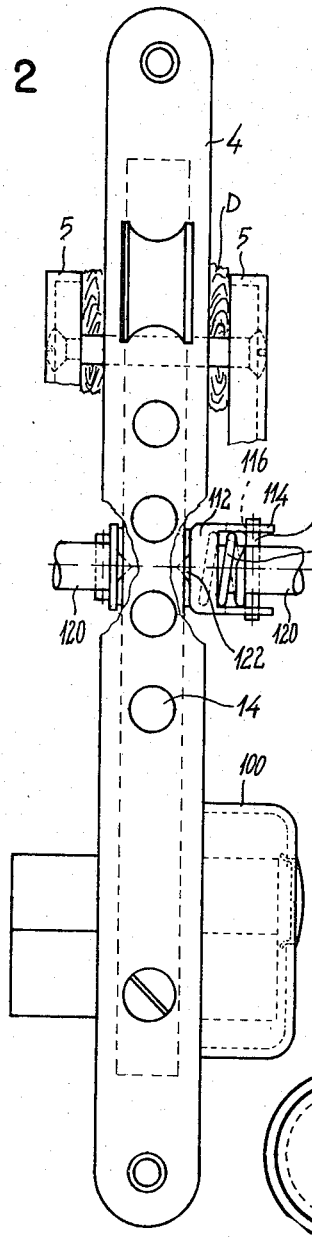
FIG. 2 is a front view of the locking device of FIG. 1.

The locking device illustrated in the drawings is for use as a rim lock mountable within one side of a door. Briefly, it comprises a casing 2 closed by a cover plate 3 and mountable within a recess formed in the free end of the door D (FIG. 2). The casing has a face plate 4 flush with the door end face, and is covered by a pair of face plates 5 (FIG. 2) mounted to the inner and outer faces of the door.

The locking device includes three locking bars 6, 8, 10 projectable from three sides of the casing within the door into recesses in the door frame, and a bolt 12 which carries four further locking bars 14 projectable through the face plate 4 at the fourth side of the door into four recesses formed in the door frame. The foregoing locking bars are driven to their locking and unlocking positions by actuator means including a manipulatable door handle 16 (FIG. 2) which is rotated in one direction to project the locking bars to their locking positions, or in the opposite direction to withdraw the locking bars to their unlocking positions. Handle 16 is in turn locked or unlocked for movement by a key-operated latch including a cylinder 18 having a slot 20 for receiving a proper key.

The drive means for driving the locking bars includes a rotatable drive gear 22 coupled to the handle 16 and meshing with four gear-cam segments 24, 26, 28 and 30. All the locking bars 6, 8, 10 and 14 (latter via bolt 12) are coupled to the gear-cam segments such that when the segments are pivotted in one direction, by rotating the drive gear 22 by means of handle 16, their respective locking bars are projected outwardly to their locking positions, and when the segments are rotated in the opposite direction, their respective locking bars are withdrawn inwardly to their unlocking positions.

Figure 4:
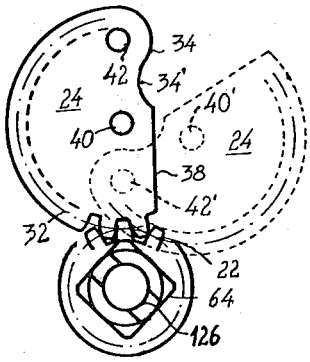
FIG. 4 illustrates the two positions of one of the gear-cam segments in the locking device of FIG. 1, the locking position of the segment being shown in full lines and its unlocking position being shown in broken lines.

The construction and operation of the gear-cam segments will be better understood by reference to FIG. 4 illustrating one of the segments, namely segment 24 which drives locking bar 6. Thus, as shown in FIG. 4, segment 24 is of substantially semi-circular shape. It includes gear teeth 32 extending for approximately 180° of the circumference of the segment which gear teeth mesh with the drive gear 22, and a cam surface formed on a second portion 34 of the circumference of the segment. The latter cam surface is engageable by the rounded end 6' of its locking bar 6 (FIG. 1), this rounded end thereby constituting a cam follower carried by the end of the locking bar. The reminder of the outer circumference of the gear-cam segment 24 is constituted of a flat surface 38 joining the end of cam surface portion 34 to the gear-teech portion 32.

Figure 3:
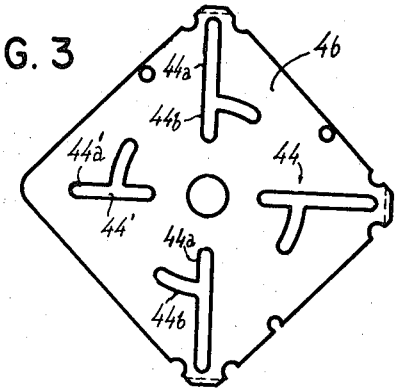
FIG. 3 is a side view of a cam plate included in the locking device of FIG. 1.
Figure 3:
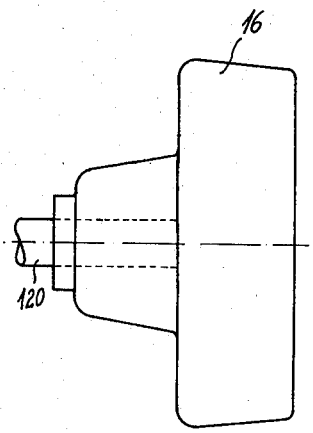

Segment 24 further includes a pair of pins disposed in a diametrical line adjacent to the cam-surface side 34 of the segment. These pins 40, 42 cooperate with a substantially T-shaped slot 44 formed in a slotted plate 46 (FIG. 3) secured within casing 2 by means of a plurality of bolts or rivets 48. As shown particularly in FIG. 3, there is one of said T-shaped cam slots 44 for each of the four gear-cam segments 24, 26, 28 and 30.

Figure 1:
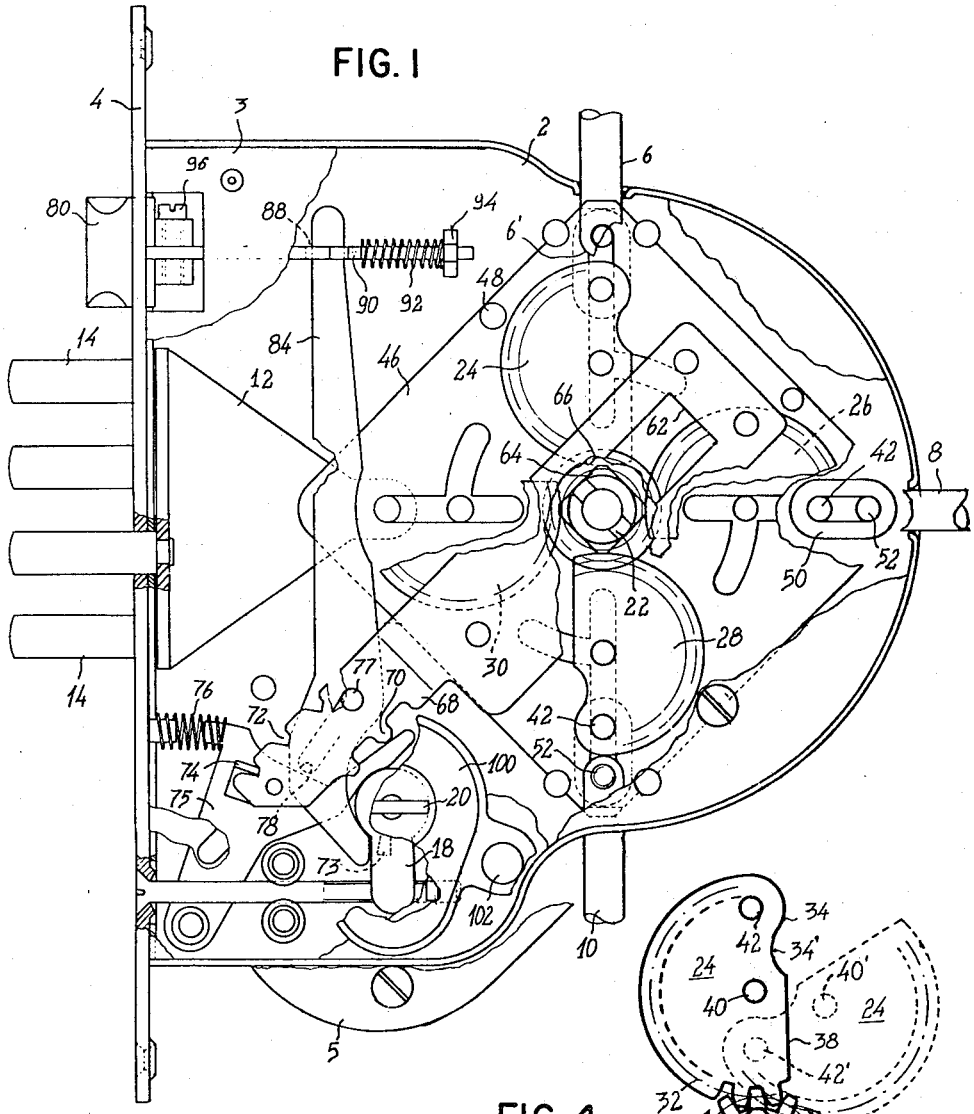
FIG. 1 is a side elevational view illustrating one form of locking device constructed in accordance with the invention, parts being broken-away to show internal structure.

Each of the T-slots 44 includes two legs **44*a*, 44*b* substantially at right angles to each other. As shown in FIG. 1, the slotted plate 46 is fixed to the casing 2 such that all the legs 44*a* are disposed along radial lines passing through the central axis of the drive gear 22, and all the slots 44*b* are disposed at substantially right angles to their respective slots 44*a* and along a circular line whose center of curvature is the central axis of drive gear 22**.

Each of the gear-cam segments 24 is disposed over cam plate 46 such that its pin 42 (FIG. 4) is located at the far end of the radial leg **44*a* of its respective T-slot 44, and its pin 40 is located at the juncture of the two legs 44*a*, 44*b*. The respective locking bar (e.g. 6) is coupled to pin 42 by means of a coupling element 50 (FIG. 1), which may be in the form of a flat metal strip having a first opening receiving pin 42 of the gear-cam cam segment 24, and another opening receiving a pin 52 carried at the end of the respective locking bar 6**.

As indicated above, in the full-line position of segment 24 in FIG. 4, its respective locking bar 6 is in the projected locking position. In order to move the locking bar to the withdrawn unlocking position, drive gear 22 is rotated (clockwise in FIG. 4), causing the gear-cam segment 24 to move to the broken-line position. During this movement, pin 40 moves from the juncture of the two legs **44*a*, 44*b* of the T-slot 44, to the end of leg 44*b*, as shown by the broken-line position 40' of pin 40; on the other hand, pin 42 moves from the outer end of leg 44*a* to the opposite, inner end of the leg, as shown by the broken-line position 42' of the pin. During this movement of pin 42 and segment 24, the rounded end 6' of locking bar 6 (which locking bar is coupled to pin 42 by coupling element 50, FIG. 1), moves along the cam surface portion 34 of the segment 24 and seats in the low surface 34'** thereof, thereby moving the locking bar to its withdrawn, unlocking position.

To move the locking bars to their projected locking positions, drive gear 22, via handle 16 is rotated in the opposite direction, whereupon the cam segments (e.g., 24 in FIG. 4) are moved to their full-line positions, the rounded inner ends (e.g. 6') of the locking bars moving along the cam surface portion (e.g. 34) of their segments to project the locking bars.

It will thus be seen that the distance between the center point of pin 42 as shown in full lines in FIG. 4, to its center point as shown in broken-lines 42', constitutes the amplitude of movement of the respective locking bar (6) when moved from its projected locking position to its withdrawn unlocking position. The described arrangement enables a large amplitude of movement to be obtainable; for example, in the described arrangement this amplitude of movement is 30 mm, as compared to a maximum of 19 mm in the locking devices now in use. As indicated earlier, this large amplitude of movement provides a deeper penetration of the locking bars when in their locking positions, thereby more securely locking the door against an attempt to make a forced opening.

In addition, it will be seen that in the projected locked positions (as well as the withdrawn locked positions) of the locking bars, the ends of the bars are in continuous engagement with the cam surface portion 34 of their respective gear-cam segments 24, 26, 28 and 30, which segments are in turn in continuous engagement with the main drive gear 22. Thus, the described arrangement greatly increases the force which the locking bars are capable of withstanding in the event of an attempt to make a forced entry, since such a force would be taken-up by the structurally strong gear-cam segments, and not by structurally weak elements such as coupling pins found in many of the presently-used locking devices. Also, the bars are in-line with the gear 22 axis.

Thus, whereas the presently used locking devices are generally capable of withstanding forces only up to 400

Kgm, the above described construction can withstand forces up to 800 Kgm, thereby providing increased protection against an attempt to make a forced entry.

Locking bars 8 and 10 are driven to their projected locking positions or to their withdrawn unlocking positions via their respective gear-cam segments 26, 28 as described above with respect to locking bar 6 driven by its segment 24. Locking bolt 12, carrying the four locking bars 14 projecting through the face plate 4 of the rim lock, is also driven in the same manner by its respective gear-cam segment, except that the radial leg, shown at 44*a*′ in FIG. 3, of its respective T-slot 44′ is slightly shorter than the radial legs of the other T-slots, so that the amplitude of movement of bolt 12, including its four locking bars 14, is slightly less than the amplitude of movement of the other locking bars 6, 8 and 10.

As indicated above, the illustrated embodiment of the invention is one wherein the locking bars are driven to their locking and unlocking positions by a handle 16, and no directly by the key-operated locking cylinder 18. The latter cylinder is operated by the key to move a latching element for either locking the handle 16 against rotation, or for releasing it enabling it to be rotated and thereby to drive the locking bars.

The latching element controlled by the key-operated cylinder 18 is in the form of a latching bar 60 having a square-shaped slot 62. The latter slot cooperates with a square-shaped element 64 fixed to the central drive gear 22, such that the opposed straight sides of the locking element 64 are normally (i.e. when the cylinder is in locking position) engaged by the sides of the rectangular slot 62, thereby locking the drive gear 22, and the handle 16 coupled thereto, against rotation. The rectangular slot 62 formed in latching bar 60 is enlarged at one end (the left end in FIG. 1) as shown at 66, such that when the cylinder 18 is rotated by the proper key inserted through the key-hole 20, the latching bar 60 is moved (rightwardly in FIG. 1) to bring the enlarged end 66 of slot 62 into alignment with the square locking element 64, thereby permitting the locking element, and the drive gear 22 to which it is fixed, to be rotated by the handle 16.

The latching bar 60 is formed at one end with an extension 68 having teeth 70 on its lower surface, and a locking slot 72 on its upper surface. Teeth 70 are engaged by a dog 73 rotated by cylinder 18 to drive the latching bar 60, and slots 72 are adapted to receive a catch 74 for locking the latching bar in position, catch 74 being carried by a pivotable arm 75 urged into locking position by a spring 76. A pin 77 carried by the casing 2 is received within an elongated slot 78 in bar extension 68 to limit the movement of the latching bar 60.

The key-operated locking cylinder 18 also actuates the spring tongue 80 projecting through the face plate 4 of the lock. For this purpose, the cylinder dog 73 also engages one end of a lever 84 pivotable on pin 77, the opposite end of lever 84 being received within a slot 88 formed in an arm 90 carrying the spring tongue 80. Arm 90 is spring-urged to the projected position of tongue 80 by a spring 92 having one end fixed to the arm and the opposite end bearing against a fixed stop 94. Tongue 80 is secured to the outer end of arm 90 by means of a bolt 96, which may be removed to permit the tongue to be inverted for either right-hand-door or left-hand-door mounting.

It will thus be seen that in the illustrated construction, the spring tongue 80 is directly actuated by the key-operated cylinder 18, whereas the locking bars 6, 8, 10 and 14 are directly actuated by the handle 16 which is in turn locked or released for actuation by the key-operated cylinder 18.

Figure 5:
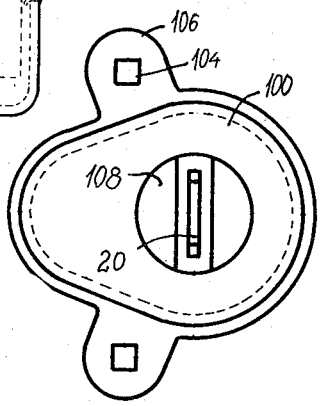
FIG. 5 is a front view illustrating a protector plate for protecting the key-operated lock cylinder in the locking device of FIG. 1.
Figure 6:
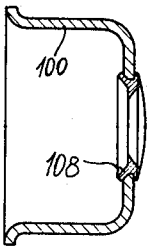
FIG. 6 is a sectional view along lines VI—VI of FIG. 5.

According to another feature in the described embodiment of the invention, special protector means are provided to protect the key-operated cylinder 18 against an attempted forced entry by using a drill. For this purpose, the key-operated cylinder 18 is covered by a bonnet-shaped protector plate 100 (FIG. 2) secured to the casing 2 by a pair of smooth-surface bolts 102 (FIG. 1) passing through openings 104 formed through lugs 106 in the protective bonnet 100, as shown particularly in FIG. 5. Bonnet 100 is formed with an opening covered by a disc 108 having the key-slot 110 for receiving the key. As shown particularly in FIG. 6, disc 108 is yieldingly secured to the opening in the protective bonnet 100, as by deforming the outer edge of the disc around the edges of the opening. The arrangement is such that if an attempt is made to drill through the lock cylinder 18, the drill will first engage the disc 108, which disc will rotate with the drill with respect to the protective bonnet 100 and thereby prevent the drill from penetrating the bonnet to the lock cylinder 18.

The illustrated locking device is provided with further protection in case a forced entry is attempted by forcing the handle 16. For this purpose, handle 16 is coupled to the main drive gear 22 via a spring-urged clutch which releases if a large force is applied if an attempt is made to rotate the handle while it is locked.

The spring-urged clutch is best illustrated in FIG. 2, wherein it will be seen that it includes a clutch member 112 having a pair of ears 114 formed with slots 116 receiving a pin 118 fixed to the inner end of the handle shaft 120. The inner face of clutch element 112 is formed with a pair of triangular projections 122 which are urged, by coil spring 124, into slots 126 (FIG. 1) formed in the square-shaped locking element 64 fixed to the center drive gear 22. Spring 124 is of sufficient force so that, under normal forces, the rotation of handle 16 will be transmitted (via clutch element 112, its projection 122, and the square-shaped locking element 64) to the drive gear 22 for rotating same to drive the locking bars 6, 8, 10, and 14 to their locking or unlocking positions, as described above. However, if a forced opening of the locked bars is attempted by rotating handle 16 while it is locked, spring 124 will permit projections 122 to unseat from recesses 126 in the locking element 64, thereby decoupling handle 16 from the drive gear 22.

While the invention has been described with respect to one preferred embodiment, it will be appreciated that many variations, modifications and other applications of the invention may be made.

What is claimed is:

1. A locking device mountable within a door and including at least one locking bar driven by actuator means to a locking position projecting from the respective side of the door into the door frame, or to an unlocking position withdrawn from the door frame, characterized in that the inner end of each locking bar includes a cam follower, and in that said actuator means includes a rotatable drive gear and a gear-cam segment for each locking bar driven by said drive gear and coupled to its respective locking bar for driving same; said segment including gear teeth formed on a first portion of its outer circumference meshing with the teeth of the drive gear, and a cam surface formed on a second portion of its outer circumference engageable by the cam follower carried by its respective locking bar.

2. A locking device according to claim 1, further characterized in that said gear-cam segment includes a pair of pins movable within a substantially T-shaped cam slot formed with first and second legs in a fixed cam plate; one of said pins being located at an intermediate portion of the gear-cam segment which, in the unlocking position thereof, is at the juncture of the two legs of the cam slot and is movable along the second leg thereof when the gear-cam segment is driven by the driven gear to its unlocking position; the other of said pins being coupled to the respective locking bar and being located at an end portion of the respective gear-cam segment which, in the unlocking position thereof, is at the outer end of the first leg of the T-shaped cam slot and is movable therealong to the inner end of said first leg when the gear-cam segment is driven by the drive gear to its unlocking position.

3. A locking device according to claim 2, further characterized in that said gear-cam segment is substantially semi-circular in configuration, being formed with said gear teeth portion extending for approximately 180° along one side of the circumference of the segment, said first and second pins being located along a diametrical line of the semi-circular segment adjacent to its opposite side, which opposite side is formed with said cam surface portion extending between said pins.

4. A locking device according to claim 2, wherein the locking device includes a plurality of said gear-cam segments for actuating locking bars projectable from a plurality of sides of the door, said cam plate being fixed to the locking device such that said first legs of all the cam slots are located on radial lines passing through the axis of said drive gear, and said second legs are all located on a circular line having its center at the axis of said drive gear.

5. A locking device according to claim 1, wherein said actuator means further includes manipulatable handle coupled to said drive gear for rotating same to actuate the locking bar, and a key-operated latch for locking the handle and drive gear against rotation.

6. A locking device according to claim 5, wherein said handle is coupled to the drive gear by a spring-urged clutch, which clutch releases if a forced opening of the door is attempted via the handle.

7. A locking device according to claim 5, wherein said key-operated latch includes a latching bar movable from a latching position to an unlatching position by a key-operated lock cylinder, said latching bar being formed with a rectangular slot receiving a locking element carried by said rotatable drive gear and having parallel straight sides engageable by the walls of the rectangular slot for locking the rotatable drive gear and the handle coupled thereto against rotary movement when the locking bar is in its latching position, said rectangular slot being enlarged at one end for permitting the rotatable drive gear and the handle coupled thereto to be rotated when the latching bar is in its unlatching position.

8. A locking device according to claim 7, further including a casing enclosing said key-operaed lock cylinder, rotatable drive gear, gear-cam segment, and the coupling to the locking bar; said locking device further including a protector plate secured to said casing so as to be disposed externally thereof and covering said key-operated cylinder, said protector plate having a circular opening covered by a circular disc formed with the key slot, which disc is yieldingly secured to the protector plate externally of the casing and aligned with said key-operated lock cylinder, such that if an attempt is made to drill through the lock cylinder, the drill will first engage the disc which disc will rotate with the drill with respect to the protector plate and thereby prevent the drill from penetrating same to the lock cylinder.

* * * * *